US008025457B2

(12) United States Patent
Halahmi et al.

(10) Patent No.: US 8,025,457 B2
(45) Date of Patent: Sep. 27, 2011

(54) GEOCELL FOR LOAD SUPPORT APPLICATIONS

(75) Inventors: Izhar Halahmi, Hod Hasharon (IL); Oded Erez, Tel Aviv (IL); Adi Erez, Tel Aviv (IL)

(73) Assignee: PRS Mediterranean Ltd., Tel Aviv (IL)

( * ) Notice: Subject to any disclaimer, the term of this patent is extended or adjusted under 35 U.S.C. 154(b) by 227 days.

(21) Appl. No.: 12/240,058

(22) Filed: Sep. 29, 2008

(65) Prior Publication Data

US 2010/0080659 A1 Apr. 1, 2010

(51) Int. Cl.
*E01C 5/08* (2006.01)

(52) U.S. Cl. ..... 404/70

(58) Field of Classification Search ..... 404/70; 442/60, 189, 199, 203, 217, 220
See application file for complete search history.

(56) References Cited

U.S. PATENT DOCUMENTS

| | | | | | |
|---|---|---|---|---|---|
| 2,139,816 | A | * | 12/1938 | Fordyce | 404/70 |
| 3,873,642 | A | | 3/1975 | Jezl | |
| 4,011,379 | A | | 3/1977 | Bow et al. | |
| 4,086,301 | A | | 4/1978 | Zerpner et al. | |
| 4,157,360 | A | | 6/1979 | Prevorsek et al. | |
| 4,168,924 | A | * | 9/1979 | Draper et al. | 404/70 |
| 4,421,439 | A | * | 12/1983 | ter Burg et al. | 405/302.7 |
| 4,428,698 | A | * | 1/1984 | Murphy et al. | 404/17 |
| 4,506,047 | A | | 3/1985 | Witman et al. | |
| 4,614,778 | A | | 9/1986 | Kajiura et al. | |
| 5,026,609 | A | * | 6/1991 | Jacob et al. | 428/489 |
| 5,091,247 | A | * | 2/1992 | Willibey et al. | 442/46 |
| 5,320,455 | A | | 6/1994 | Mattox | |
| 5,326,602 | A | | 7/1994 | Rifi | |
| 5,714,218 | A | | 2/1998 | Nishio et al. | |
| 5,714,573 | A | | 2/1998 | Randall et al. | |
| 5,735,640 | A | * | 4/1998 | Meyer et al. | 405/302.7 |
| 5,744,535 | A | | 4/1998 | Akagawa et al. | |
| 5,836,715 | A | * | 11/1998 | Hendrix et al. | 404/134 |
| 5,981,692 | A | | 11/1999 | LeBoeuf | |
| 6,020,275 | A | | 2/2000 | Stevenson et al. | |
| 6,440,529 | B1 | * | 8/2002 | Baumgart et al. | 428/137 |
| 6,484,473 | B1 | * | 11/2002 | Hall | 52/741.1 |
| 6,541,568 | B1 | | 4/2003 | Ding et al. | |
| 2006/0147275 | A1 | * | 7/2006 | Lin et al. | 405/302.4 |
| 2006/0182941 | A1 | | 8/2006 | Yano et al. | |
| 2006/0235130 | A1 | | 10/2006 | Hanner et al. | |
| 2007/0106006 | A1 | | 5/2007 | Cooper et al. | |
| 2007/0191546 | A1 | | 8/2007 | Garois et al. | |

OTHER PUBLICATIONS

International Search Report dated Dec. 8, 2008.

* cited by examiner

*Primary Examiner* — Thomas Will
*Assistant Examiner* — Abigail A Risic
(74) *Attorney, Agent, or Firm* — Fay Sharpe LLP; Richard M. Klein

(57) ABSTRACT

A geocell is disclosed that has high strength and stiffness, such that the geocell has a storage modulus of 500 MPa or greater at 23° C.; a storage modulus of 150 MPa or greater at 63° C. when measured in the machine direction using Dynamic Mechanical Analysis (DMA) at a frequency of 1 Hz; a tensile stress at 12% strain of 14.5 MPa or greater at 23° C.; a coefficient of thermal expansion of $120\times10^{-6}$/° C. or less at 25° C.; and/or a long term design stress of 2.6 MPa or greater. The geocell is suitable for load support applications, especially for reinforcing base courses and/or subbases of roads, pavement, storage areas, and railways.

27 Claims, 7 Drawing Sheets

GEOCELL FOR LOAD SUPPORT APPLICATIONS

BACKGROUND

The present disclosure relates to a cellular confinement system, also known as a CCS or a geocell, which is suitable for use in supporting loads, such as those present on roads, railways, parking areas, and pavements. In particular, the geocells of the present disclosure retain their dimensions after large numbers of load cycles and temperature cycles; thus the required confinement of the infill is retained throughout the design life cycle of the geocell.

A cellular confinement system (CCS) is an array of containment cells resembling a "honeycomb" structure that is filled with granular infill, which can be cohesionless soil, sand, gravel, ballast, crushed stone, or any other type of granular aggregate. Also known as geocells, CCSs are mainly used in civil engineering applications that require little mechanical strength and stiffness, such as slope protection (to prevent erosion) or providing lateral support for slopes.

CCSs differ from other geosynthetics such as geogrids or geotextiles in that geogrids/geotextiles are flat (i.e., two-dimensional) and used as planar reinforcement. Geogrids/geotextiles provide confinement only for very limited vertical distances (usually 1-2 times the average size of the granular material) and are limited to granular materials having an average size of greater than about 20 mm. This limits the use of such two-dimensional geosynthetics to relatively expensive granular materials (ballast, crushed stone and gravel) because they provide hardly any confinement or reinforcement to lower quality granular materials, such as recycled asphalt, crushed concrete, fly ash and quarry waste. In contrast, CCSs are three-dimensional structures that provide confinement in all directions (i.e. along the entire cross-section of each cell). Moreover, the multi-cell geometry provides passive resistance that increases the bearing capacity. Unlike two-dimensional geosynthetics, a geocell provides confinement and reinforcement to granular materials having an average particle size less than about 20 mm, and in some cases materials having an average particle size of about 10 mm or less.

Geocells are manufactured by some companies worldwide, including Presto. Presto's geocells, as well as those of most of its imitators, are made of polyethylene (PE). The polyethylene (PE) can be high density polyethylene (HDPE) or medium density polyethylene (MDPE). The term "HDPE" refers hereinafter to a polyethylene characterized by density of greater than 0.940 g/cm$^3$. The term medium density polyethylene (MDPE) refers to a polyethylene characterized by density of greater than 0.925 g/cm$^3$ to 0.940 g/cm$^3$. The term low density polyethylene (LDPE) refers to a polyethylene characterized by density of 0.91 to 0.925 g/cm$^3$.

Geocells made from HDPE and MDPE are either smooth or texturized. Texturized geocells are most common in the market, since the texture may provide some additional friction of the geocell walls with the infill. Although HDPE theoretically can have a tensile strength (tensile stress at yield or at break) of greater than 15 megapascals (MPa), in practice, when a sample is taken from a geocell wall and tested according to ASTM D638, the strength is insufficient for load support applications, such as roads and railways, and even at a high strain rate of 150%/minute, will barely reach 14 MPa.

The poor properties of HDPE and MDPE are clearly visible when analyzed by Dynamic Mechanical Analysis (DMA) according to ASTM D4065: the storage modulus at 23° C. is lower than about 400 MPa. The storage modulus deteriorates dramatically as temperature increases, and goes below useful levels at temperatures of about 75° C., thus limiting the usage as load support reinforcements. These moderate mechanical properties are sufficient for slope protection, but not for long term load support applications that are designed for service of more than five years.

Another method for predicting the long term, creep-related behavior of polymers is the accelerated creep test by stepped isothermal method (SIM) according to ASTM 6992. In this method, a polymeric specimen is subjected to constant load under a stepped temperature program. The elevated temperature steps accelerate creep. The method enables extrapolation of the specimen's properties over long periods of time, even over 100 years. Usually, when PE and PP are tested, the load that causes plastic deformation of 10% is called the "long term design strength" and is used in geosynthetics as the allowed strength for designs. Loads that cause plastic deformation greater than 10% are avoided, because PE and PP are subject to second order creep above 10% plastic deformation. Second order creep is unpredictable and PE and PP have a tendency to "craze" in this mode.

For applications such as roads, railroads and heavily loaded storage and parking yards, this strength of barely 14 MPa is insufficient. In particular, geocells with these moderate mechanical properties tend to have relatively low stiffness and tend to deform plastically at strains as low as 8%. The plastic deformation causes the cell to lose its confining potential, essentially the major reinforcement mechanism, after short periods of time or low numbers of vehicles passing (low number of cyclic loads). For example, when a strip taken from a typical geocell in the machine direction (perpendicular to seam plane) is tested according to ASTM D638 at a strain rate of 20%/minute or even at 150%/minute, the stress at 6% strain is less than 13 MPa, at 8% strain is less than 13.5 MPa, and at 12% strain is less than 14 MPa. As a result, HDPE geocells are limited to applications where the geocell is under low load and where confinement of load-bearing infill is not mandatory (e.g. in soil stabilization). Geocells are not widely accepted in load support applications, such as roads, railways, parking areas, or heavy container storage areas, due to the high tendency of plastic deformation at low strains.

When a vertical load is applied to a substrate of a granular material, a portion of that vertical load is translated to a horizontal load or pressure. The magnitude of the horizontal load is equal to the vertical load multiplied by the coefficient of horizontal earth pressure (also known as lateral earth pressure coefficient or LEPC) of the granular material. The LEPC can vary from about 0.2 for good materials like gravel and crushed stone (generally hard particles, poorly graded, so compaction is very good and plasticity is minimal) to about 0.3 to 0.4 for more plastic materials like quarry waste or recycled asphalt (materials that have a high fines content and high plasticity). When the granular material is wet (e.g. rain or flood saturating the base course and sub-base of a road), its plasticity increases, and higher horizontal loads are developed, providing increased hoop stress in the cell wall.

When the granular material is confined by a geocell, and a vertical load is applied from the top by a static or dynamic stress (such as pressure provided by a vehicle wheel or train rail), the horizontal pressure is translated to hoop stress in the geocell wall. The hoop stress is proportional to the horizontal pressure and to the average cell radius, and is inversely proportional to the thickness of the cell wall.

$$HS = \frac{VP * LEPC * r}{d}$$

wherein HS is the average hoop stress in the geocell wall, VP is the vertical pressure applied externally on the granular material by a load, LEPC is the lateral earth pressure coefficient, r is the average cell radius and d is the nominal cell wall thickness.

For example, a geocell made of HDPE or MDPE having a cell wall thickness of 1.5 millimeters (including texture, and the term "wall thickness" referring hereinafter to the distance from peak to peak on the cell wall cross-section), an average diameter (when infilled with granular material) of 230 millimeters, a height of 200 millimeters, filled with sand or quarry waste (a LEPC of 0.3), and a vertical load of 700 kilopascal (kPa), would experience a hoop stress of about 16 megapascals (MPa). As seen from the hoop stress equation, larger diameter or thinner walls—which are favored from a manufacturing economy point of view—are subjected to significantly higher hoop stresses, and thus do not operate well as reinforcement when made of HDPE or MDPE.

Vertical loads of 550 kPa are common for unpaved roads. Significantly higher loads, of 700 kPa or more, may be experienced in roads (paved and unpaved) for heavy trucks, industrial service roads, or parking areas.

Because load support applications, especially roads and railways, are generally subjected to millions of cyclic loads, the geocell wall needs to retain its original dimensions under cyclic loading with very low plastic deformation. Commercial usage of HDPE geocells is limited to non load-bearing applications because HDPE typically reaches its plastic limit at about 8% strain, and at stresses below typical stresses commonly found in load support applications.

It would be desirable to provide a geocell that has increased stiffness and strength, lower tendency to deform at elevated temperatures, better retention of its elasticity at temperatures above ambient (23° C.), reduced tendency to undergo plastic deformation under repeated and continuous loadings, and/or long service periods.

BRIEF DESCRIPTION

Disclosed in embodiments are geocells which provide sufficient stiffness and can accept high stresses without plastic deformation. Such geocells are suitable for load support applications such as pavements, roads, railways, parking areas, airport runways, and storage areas. Methods for making and using such geocells are also disclosed.

In some embodiments is disclosed a geocell formed from polymeric strips, at least one polymeric strip having a storage modulus of 500 MPa or greater when measured in the machine direction by Dynamic Mechanical Analysis (DMA) according to ASTM D4065 at 23° C. and at a frequency of 1 Hz.

The at least one polymeric strip may have a storage modulus of 700 MPa or greater, including a storage modulus of 1000 MPa or greater.

The at least one polymeric strip may have a stress at 12% strain of 14.5 MPa or greater when measured according to the Izhar procedure at 23° C., including a stress at 12% strain of 16 MPa or greater or a stress at 12% strain of 18 MPa or greater.

The at least one polymeric strip may have a coefficient of thermal expansion of $120\times10^{-6}$/° C. or less at 25° C. according to ASTM D696.

The geocell may be used in a layer of a pavement, road, railway, or parking area. The geocell can be filled with a granular material selected from the group consisting of sand, gravel, crushed stone, ballast, quarry waste, crushed concrete, recycled asphalt, crushed bricks, building debris and rubble, crushed glass, power plant ash, fly ash, coal ash, iron blast furnace slag, cement manufacturing slag, steel slag, and mixtures thereof.

In other embodiments is disclosed a geocell formed from polymeric strips, at least one polymeric strip having a storage modulus of 150 MPa or greater when measured in the machine direction by Dynamic Mechanical Analysis (DMA) according to ASTM D4065 at 63° C. and at a frequency of 1 Hz.

The at least one polymeric strip may have a storage modulus of 250 MPa or greater, including a storage modulus of 400 MPa or greater.

In yet other embodiments is disclosed a geocell formed from polymeric strips, at least one polymeric strip having a long term design stress of 2.6 MPa or greater, when measured according to the PRS SIM procedure.

The at least one polymeric strip may have a long term design stress of 3 MPa or greater, including a long term design stress of 4 MPa or greater.

These and other embodiments are described in more detail below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

The following detailed description is provided so as to enable a person of ordinary skill in the art to make and use the embodiments disclosed herein and sets forth the best modes contemplated of carrying out these embodiments. Various modifications, however, will remain apparent to those of ordinary skill in the art and should be considered as being within the scope of this disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Figure 1:
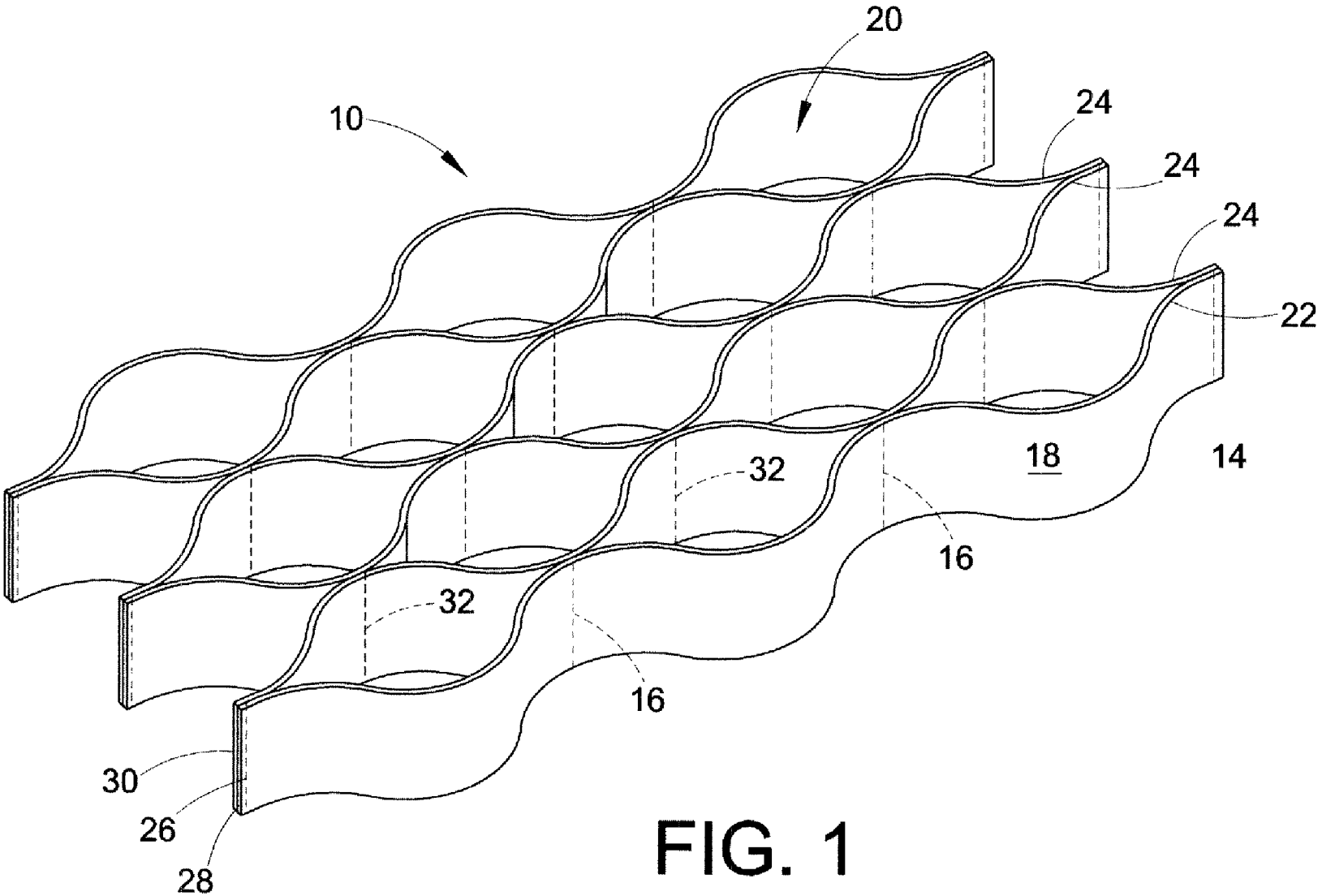
FIG. 1 is a perspective view of a geocell.

FIG. 1 is a perspective view of a single layer geocell. The geocell 10 comprises a plurality of polymeric strips 14. Adjacent strips are bonded together by discrete physical joints 16. The bonding may be performing by bonding, sewing or welding, but is generally done by welding. The portion of each strip between two joints 16 forms a cell wall 18 of an individual cell 20. Each cell 20 has cell walls made from two different polymeric strips. The strips 14 are bonded together to form a honeycomb pattern from the plurality of strips. For example, outside strip 22 and inside strip 24 are bonded together by physical joints 16 which are regularly spaced along the length of strips 22 and 24. A pair of inside strips 24 is bonded together by physical joints 32. Each joint 32 is between two joints 16. As a result, when the plurality of strips 14 is stretched in a direction perpendicular to the faces of the strips, the strips bend in a sinusoidal manner to form the geocell 10. At the edge of the geocell where the ends of two polymeric strips 22, 24 meet, an end weld 26 (also considered a joint) is made a short distance from the end 28 to form a short tail 30 which stabilizes the two polymeric strips 22, 24.

The geocells of the present disclosure are made polymeric strips that have certain physical properties. In particular, the polymeric strip has a stress at yield, or at 12% strain when the polymeric strip has no yield point, of 14.5 MPa or greater when measured in the machine direction (perpendicular to seam plane in the geocell cell) at a strain rate of 20%/minute or 150%/minute. In other embodiments, the polymeric strip has a strain of 10% or less at a stress of 14.5 MPa, when measured as described. In other words, the polymeric strip can withstand stresses of 14 MPa or greater without reaching its yield point. Other synonyms for the yield point include the stress at yield, the elastic limit, or the plastic limit. When the polymeric strip has no yield point, the stress is considered at 12% strain. These measurements relate to the tensile properties of the polymeric strip in the machine direction, at 23° C., not its flexural properties.

Because many geocells are perforated, measuring the stress and strain according to the ASTM D638 or ISO 527 standards is generally impossible. Thus, the measurements are taken according to the following procedure, which is a modified version of said standards and is referred to herein as "the Izhar procedure". A strip 50 mm long and 10 mm wide is sampled in the direction parallel to ground level and perpendicular to the seam plane of the cell (i.e. in the machine direction). The strip is clamped so that the distance between clamps is 30 mm. The strip is then stretched by moving the clamps away from each other at a speed of 45 millimeters (mm) per minute, which translates to a strain rate of 150%/minute, at 23° C. The load provided by the strip in response to said deformation is monitored by a load cell. The stress ($N/mm^2$) is calculated at different strains (the strain is the increment of length, divided by original length). The stress is calculated by dividing the load at specific strain by the original nominal cross-section (the width of the strip multiplied by the thickness of the strip) Since the surface of the geocell strip is usually texturized, the thickness of the sample is measured simply as "peak to peak" distance, averaged between three points on the strip. (For example, a strip, having an embossed diamond like texture, and having a distance between the uppermost texture of top side and the lowermost texture of the bottom side of 1.5 mm, is regarded as 1.5 mm thick.) This strain rate of 150%/minute is more relevant to pavements and railways, where each load cycle is very short.

In other embodiments, the polymeric strip may be characterized as having:

a strain of at most 1.9% at a stress of 8 MPa;
a strain of at most 3.7% at a stress of 10.8 MPa;
a strain of at most 5.5% at a stress of 12.5 MPa;
a strain of at most 7.5% at a stress of 13.7 MPa;
a strain of at most 10% at a stress of 14.5 MPa;
a strain of at most 11% at a stress of 15.2 MPa; and
a strain of at most 12.5% at a stress of 15.8 MPa.

The polymeric strip may also have, optionally, a strain of at most 14% at a stress of 16.5 MPa; and/or a strain of at most 17% at a stress of 17.3 MPa.

In other embodiments, the polymeric strip may be characterized as having a stress of at least 14.5 MPa at a strain of 12%; a stress of at least 15.5 MPa at a strain of 12%; and/or a stress of at least 16.5 MPa at a strain of 12%.

In other embodiments, the polymeric strip may be characterized as having a storage modulus of 500 MPa or greater at 23° C., measured in the machine direction by Dynamic Mechanical Analysis (DMA) at a frequency of 1 Hz. As with the tensile stress-strain measurement, the thickness for the DMA analysis is taken as "peak to peak" distance, averaged between three points. The DMA measurements described in the present disclosure are made according to ASTM D4065.

In other embodiments, the polymeric strip may be characterized as having a storage modulus of 250 MPa or greater at 50° C., measured in the machine direction by Dynamic Mechanical Analysis (DMA) at a frequency of 1 Hz.

In other embodiments, the polymeric strip may be characterized as having a storage modulus of 150 MPa or greater at 63° C., measured in the machine direction by Dynamic Mechanical Analysis (DMA) at a frequency of 1 Hz.

In other embodiments, the polymeric strip may be characterized as having a Tan Delta of 0.32 or less at 75° C., measured in the machine direction by Dynamic Mechanical Analysis (DMA) at a frequency of 1 Hz. These novel properties are beyond the properties of typical HDPE or MDPE geocells.

Dynamic Mechanical Analysis (DMA) is a technique used to study and characterize the viscoelastic nature of polymers. Generally, an oscillating force is applied to a sample of material and the resulting cyclic displacement of the sample is measured versus the cyclic loading. The higher the elasticity, the lower the time lag (phase) between the load and the displacement. From this, the pure stiffness (storage modulus) of the sample can be determined, as well as the dissipating mechanism (loss modulus) and the ratio between them (Tan Delta). DMA is also discussed in ASTM D4065. DMA is the state-of-the-art technology when analyzing (1) time dependent phenomena such as creep; or (2) frequency dependent phenomena such as damping, cyclic loading, or fatigue, that are very common in transportation engineering.

Another aspect of the geocell of the present disclosure is its lower coefficient of thermal expansion (CTE) relative to current HDPE or MDPE. The CTE is important because the expansion/contraction during thermal cycling is another mechanism that provides additional hoop stresses as well. HDPE and MDPE have a CTE of about $200\times10^{-6}$/° C. at ambient (23° C.), and that CTE is even higher at temperatures greater than ambient. The geocell of the present disclosure has a CTE of about $150\times10^{-6}$/° C. or less at 23° C., and in specific embodiments about $120\times10^{-6}$/° C. or less at 23° C. when measured according to ASTM D696. The CTE of the geocell of the present disclosure has lower tendency to increase at elevated temperatures.

Another aspect of the geocell of the present disclosure is its lower creep tendency under constant load. The lower creep tendency is measured according to accelerated creep test by stepped isothermal method (SIM), as described in ASTM 6992. In this method, a polymeric specimen is subjected to a constant load under a stepped temperature program (i.e. the temperature is increased and held constant for a predefined period). The elevated temperature steps accelerate creep. The procedure of SIM test is applied to a sample of 100 mm width and net length of 50 mm (distance between clamps). The sample is loaded by a static load and heated according to a procedure comprising the steps:

| Step | T Celsius | time hours |
|---|---|---|
| 0 | 23 | 0 |
| 1 | 30 | 3 |
| 2 | 37 | 3 |
| 3 | 44 | 3 |
| 4 | 51 | 3 |
| 5 | 58 | 3 |
| 6 | 65 | 3 |
| 7 | 72 | 3 |

This SIM procedure is referred to herein as "the PRS SIM procedure". The plastic strain (irreversible increase in length, divided by initial length) at the end of the procedure is measured. The plastic strain is measured against different loads, and the load that causes plastic strain of 10% or less is called the "long term design load." The stress related to the long term design load (said load, divided by (original width multiplied by original)) is the "long term design stress" and provides the allowed hoop stress the geocell can tolerate for a long period of time under a static load.

A typical HDPE geocell, when subjected to the PRS SIM procedure, can barely provide a long term design stress of 2.2 MPa.

In some embodiments, the polymeric strip according to the present disclosure are characterized by a long term design stress of 2.6 MPa or greater, including a long term design stress of 3 MPa or greater, or even 4 MPa or greater.

Unlike HDPE geocells, the geocell of the present disclosure can provide significantly better properties up to 16% strain and in some embodiments up to 22% strain. In particular, the geocell can respond elastically to stresses greater than 14.5 MPa, thus providing the required properties for load support applications. The elastic response guarantees complete recovery to original dimensions when the load is removed. The geocell will provide the infill with a higher load bearing capacity and increased rebound to its original diameter under repeated loadings (i.e. cyclic loads). Moreover, the geocell of the present disclosure can be used with granular materials that generally cannot be used in base courses and sub-bases, as described further herein. The geocell of the present disclosure also enables better load bearing and fatigue resistance under humid conditions, especially when fine grained granular materials are used.

The polymeric strip may include a polyethylene (PE) polymer, such as HDPE, MDPE, or LDPE, which has been modified as described further below.

The polymeric strip may also include a polypropylene (PP) polymer. Although most PP homopolymers are too brittle and most PP copolymers are too soft for load support applications, some grades of PP polymers are useful. Such PP polymers can be stiff enough for the load support application, yet soft enough that the geocell can be folded up. Exemplary polypropylene polymers suitable for the present disclosure include polypropylene random copolymers, polypropylene impact copolymers, blends of polypropylene with either an ethylene-propylene-diene-monomer (EPDM) or an ethylene alpha-olefin copolymer based elastomer, and polypropylene block copolymers. Such PP polymers are commercially available as R338-02N from Dow Chemical Company; PP 71 EK71 PS grade impact copolymer from SABIC Innovative Plastics; and PP RA1E10 random copolymer from SABIC Innovative Plastics. Exemplar ethylene alpha-olefin copolymer based elastomers include Exact® elastomers manufactured by Exxon Mobil and Tafiner® elastomers manufactured by Mitsui. Since PP polymers are brittle at low temperatures (lower than about minus 20° C.) and tend to creep under static or cyclic loadings, geocells of the present disclosure which incorporate PP may be less load-bearing and more restricted as to their operating temperatures than geocells of the present disclosure which incorporate HDPE.

The PP and/or PE polymers or any other polymeric composition according the present disclosure are generally modified, through various treatment process and/or additives, to attain the required physical properties. The most effective treatment is post-extrusion treatment, either downstream from the extrusion machine, or in a separate process afterwards. Usually, lower crystallinity polymers such as LDPE, MDPE, and some PP polymers will require a post-extrusion process such as orientation, cross-linking, and/or thermal annealing, while higher crystallinity polymers can be extruded as strips and welded together to form a geocell without the need to apply post-extrusion treatment.

In some embodiments, the polymeric strip comprises a blend (usually as a compatibilized alloy) of (i) a high performance polymer and (ii) a polyethylene or polypropylene polymer. The blend is generally an immiscible blend (an alloy), wherein the high performance polymer is dispersed in a matrix formed by the polyethylene or polypropylene polymer. A high performance polymer is a polymer having (1) a storage modulus of 1400 MPa or greater at 23° C., measured in the machine direction by Dynamic Mechanical Analysis (DMA) at a frequency of 1 Hz according to ASTM D4065; or (2) an ultimate tensile strength of at least 25 MPa. Exemplary high performance polymers include polyamide resins, polyester resins, and polyurethane resins. Particularly suitable high performance polymers include polyethylene terephthalate (PET), polyamide 6, polyamide 66, polyamide 6/66, polyamide 12, and copolymers thereof. The high performance polymer typically comprises from about 5 to about 85 weight percent of the polymeric strip. In particular embodiments, the high performance polymer is from about 5 to about 30 weight percent of the polymeric strip, including from about 7 to about 25 weight percent.

The properties of the polymeric strips can be modified either prior to forming the geocell (by welding of the strips) or after forming the geocell. The polymeric strips are generally made by extruding a sheet of polymeric material and cutting strips from said sheet of polymeric material, and the modification generally is made to the sheet for efficiency. The modification can be done in-line to the extrusion process, after the melt is shaped to a sheet and the sheet is cooled to lower than the melting temperature, or as a secondary process after the sheet is separated from the extruder die. The modification can be done by treating the sheet, strips, and/or geocell by cross-linking, crystallization, annealing, orientation, and combinations thereof.

For example, a sheet which is 5 to 500 cm wide may be stretched (i.e. orientation) at a temperature range from about 25° C. to about 10° C. below the peak melting temperature (Tm) of the polymeric resin used to make the sheet. The orientation process changes the strip length, so the strip may increase in length from 2% to 500% relative to its original length. After stretching, the sheet can be annealed. The annealing may occur at a temperature which is 2 to 60° C. lower than the peak melting temperature (Tm) of the polymeric resin used to make the sheet. For example, if a HDPE, MDPE or PP sheet is obtained, the stretching and/or annealing is done at a temperature of from about 24° C. to 150° C. If a polymeric alloy is annealed, the annealing temperature is 2 to 60° C. lower than the peak melting temperature (Tm) of the HDPE, MDPE, or PP phase.

In some specific embodiments, a polymeric sheet or strip is stretched to increase its length by 50% (i.e. so the final length is 150% of the original length). The stretching is done at a temperature of about 100-125° C. on the surface of the polymeric sheet or strip. The thickness is reduced by 10% to 20% due to the stretching.

In other embodiments, a polymeric sheet or strip is cross-linked by irradiation with an electron beam after extrusion or by the addition of a free radical source to the polymeric composition prior to melting or during melt kneading in the extruder.

In other embodiments, the required properties for the geocell can be obtained by providing multi-layer polymeric strips. In some embodiments, the polymeric strips have at least two, three, four, or five layers.

Figure 2:
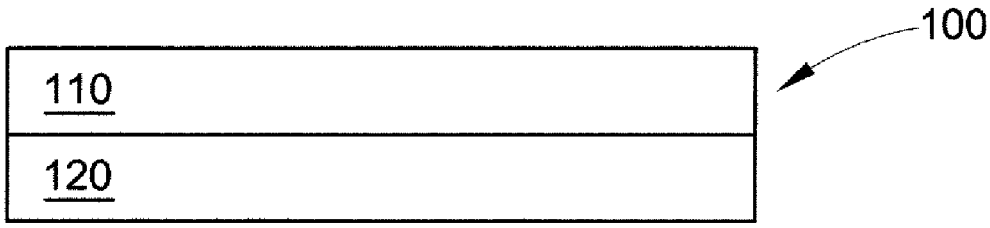
FIG. 2 is a diagram showing an exemplary embodiment of a polymeric strip used in the geocells of the present disclosure.

In some embodiments as shown in FIG. 2, the polymeric strip 100 has at least two layers 110, 120, wherein two of the layers are made from same or different compositions and at least one layer is made of a high performance polymer or polymer compound having (1) storage modulus of 1400 MPa or greater at 23° C., measured in the machine direction by Dynamic Mechanical Analysis (DMA) at a frequency of 1 Hz according to ASTM D4065; or (2) an ultimate tensile strength of at least 25 MPa. In embodiments, one layer comprises a high performance polymer and the other layer comprises a polyethylene or polypropylene polymer, which may be a blend or alloy of a polyethylene or polypropylene polymer with other polymers, fillers, additives, fibers and elastomers. Exemplary high performance resins include polyamides, polyesters, polyurethanes; alloys of (1) polyamides, polyesters, or polyurethanes with (2) LDPE, MDPE, HDPE, or PP; and copolymers, block copolymers, blends or combinations of any two of the three polymers (polyamides, polyesters, polyurethanes).

Figure 3:
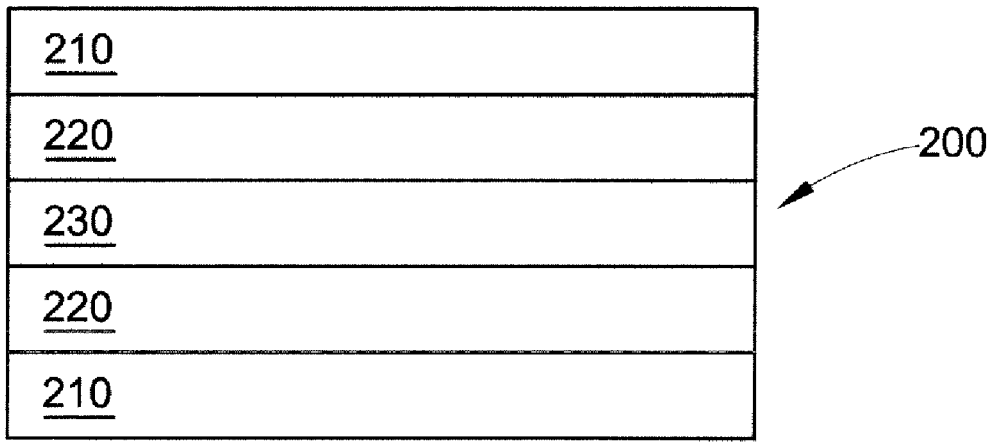
FIG. 3 is a diagram showing another exemplary embodiment of a polymeric strip used in the geocells of the present disclosure.

In other embodiments as shown in FIG. 3, the polymeric strip 200 has five layers. Two of the layers are outer layers 210, one layer is a core layer 230, and the two intermediate layers 220 bond the core layer to each outer layer (i.e. so the intermediate layers serve as tie layers). This five-layer strip can be formed by co-extrusion.

In other embodiments, the polymeric strip 200 has only three layers. Two of the layers are outer layers 210, and the third layer is core layer 230. In this embodiment, the intermediate layers 220 are not present. This three-layer strip can be formed by co-extrusion.

The outer layers may provide resistance against ultraviolet light degradation and hydrolysis, and has good weldability. The outer layer can be made from a polymer selected from the group consisting of HDPE, MDPE, LDPE, polypropylene, blends thereof, and alloys thereof with other compounds and polymers. Those polymers may be blended with elastomers, especially EPDM and ethylene-alpha olefin copolymers. The core and/or outer layer can also be made from alloys of (1) HDPE, MDPE, LDPE, or PP with (2) a polyamide or polyester. Each outer layer may have a thickness of from about 50 to about 1500 micrometers (microns).

The intermediate (tie) layers can be made from functionalized HDPE copolymers or terpolymers, functionalized PP copolymers or terpolymers, a polar ethylene copolymer, or a polar ethylene terpolymer. Generally, the HDPE and PP copolymers/terpolymers contain reactive end groups and/or side-groups which allow for chemical bond formation between the intermediate layers (tie layers) and the outer layer. Exemplary reactive side-groups include carboxyl, anhydride, oxirane, amino, amido, ester, oxazoline, isocyanate or combinations thereof. Each intermediate layer may have a thickness of from about 5 to about 500 micrometers. Exemplary intermediate layer resins include Lotader® resins manufactured by Arkema and Elvaloy®, Fusabond®, or Surlyn® resins manufactured by DuPont.

The core and/or outer layer may comprise a polyester and alloys thereof with PE or PP, a polyamide and alloys thereof with PE or PP, and blends of polyester and polyamide and alloys thereof with PE or PP. Exemplary polyamides include polyamide 6, polyamide 66, and polyamide 12. Exemplary polyesters include polyethylene terephthalate (PET) and polybutylene terephthalate (PBT). The core and/or outer layer may have a thickness of from about 50 to about 2000 micrometers.

Figure 4:
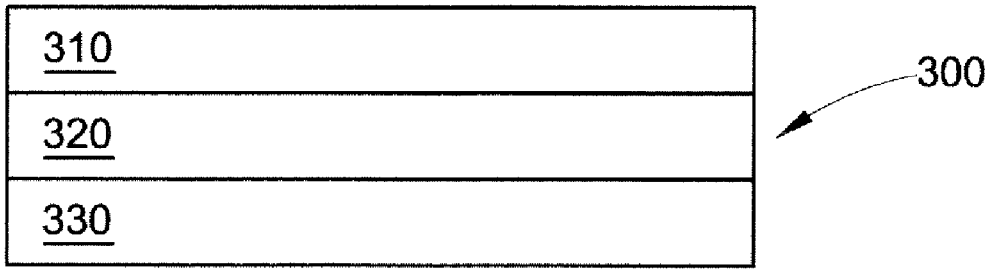
FIG. 4 is a diagram showing another exemplary embodiment of a polymeric strip used in the geocells of the present disclosure.

In other embodiments as shown in FIG. 4, the polymeric strip 300 has three layers: a top layer 310, a center layer 320, and a bottom layer 330. The top layer is the same as the outer layer previously described; the center layer is the same as the intermediate layer previously described; and the bottom layer is the same as the core layer previously described.

Geocells are generally embossed (texturized by pressing the semi-solid mass after extrusion against a texturized roll) to increase friction with granular infill or with soil. Geocells may also be perforated to improve friction with granular infill and water drainage. However, both embossing and perforation reduce the stiffness and strength of the geocell. Since these friction aids are usually present, it is necessary to provide enhanced strength and stiffness to the geocell, by altering its polymer composition and/or morphology.

The polymeric strip may further comprise additives to attain the required physical properties. Such additives may be selected from, among others, nucleating agents, fillers, fibers, nanoparticles, hindered amine light stabilizers (HALS), antioxidants, UV light absorbers, and carbon black.

Fillers may be in the form of powders, fibers, or whiskers. Exemplary fillers include a metal oxide, such as aluminum oxide; a metal carbonate, such as calcium carbonate, magnesium carbonate, or calcium-magnesium carbonate; a metal sulfate, such as calcium sulfate; a metal phosphate; a metal silicate—especially talc, kaolin, mica, or wollastonite; a metal borate; a metal hydroxide; a silica; a silicate; an; an alumo-silicate; chalk; talc; dolomite; an organic or inorganic fiber or whisker; a metal; metal-coated inorganic particles; clay; kaolin; industrial ash; concrete powder; cement; or mixtures thereof. In some embodiments, the filler has an average particle size of less than 10 microns, and in some embodiments, also has an aspect ratio of greater than one. In specific embodiments, the fillers is mica, talc, kaolin, and/or wollastonite. In other embodiments, the fibers have a diameter lower than 1 micron.

Nanoparticles can be added to the polymeric composition for various purposes. For example, inorganic UV-absorbing solid nanoparticles have practically no mobility and are therefore very resistant against leaching and/or evaporation. UV-absorbing solid nanoparticles are also transparent in the visible spectrum and are distributed very evenly. Therefore, they provide protection without any contribution to the color or shade of the polymer. Exemplary UV-absorbing nanoparticles comprise a material selected from the group consisting of titanium salts, titanium oxides, zinc oxides, zinc halides, and zinc salts. In particular embodiments, the UV-absorbing nanoparticles are titanium dioxide. Examples of commercially available UV-absorbing particles are SACHTLEBEN™ Hombitec RM 130F TN, by Sachtleben, ZANO™ zinc oxide by Umicore, NanoZ™ zinc oxide by Advanced Nanotechnology Limited and AdNano Zinc Oxide™ by Degussa.

The polymeric strips from which the geocell is formed are made by various processes. Generally, the process comprises melting a polymeric composition, extruding the composition through an extruder die as a molten sheet, forming and optionally texturizing the resulting sheet, treating the sheet as needed to obtain the desired properties, cutting the sheet to strips, and welding, sewing, bonding, or riveting strips formed from the sheet together into a geocell. First, the various components, such as the polymeric resins and any desired additives are melt kneaded, usually in an extruder or co-kneader. This can be done in, for example, an extruder, such as a twin-screw extruder or single screw extruder with enough mixing elements, which provides the needed heat and shearing with minimal degradation to the polymer. The composition is melt kneaded so that any additives are thoroughly dispersed. The composition is then extruded through a die, and pressed between metal calendars into sheet form. Exemplary treatments provided downstream of the extruder die include texturing the surface of the sheet, perforating the sheet, orientation (unidirectional or bi-directional), irradiation with electron beam or x-rays, and thermal annealing. In some embodiments, the sheet is heat treated to increase crystallinity and reduce internal stresses. In other embodiments, the sheet is treated to induce cross linking in the polymeric resin by means or electron beam, x-ray, heat treatment, and combinations thereof. Combinations of the above treatments are also contemplated.

Strips can be formed from the resulting sheet and welded, sewed, or bonded together to form a geocell. Such methods are known in the art. The resulting geocell is able to retain its stiffness under sustained load cycling over extended periods of time.

The geocells of the present disclosure are useful for load support applications that current geocells cannot be used for. In particular, the present geocells can also use infill materials that are typically not suitable for load support applications for base courses, subbases, and subgrades In particular, the geocells of the present disclosure allow the use of materials for the infill that were previously unsuitable for use in load support applications, such as base courses and subbases, due to their insufficient stiffness and relatively poor fatigue resistance (in granular materials, fatigue resistance is also known as resilient modulus). Exemplary granular infill materials that may now be used include quarry waste (the fine fraction remaining after classification of good quality granular materials), crushed concrete, recycled asphalt, crushed bricks, building debris and rubble, crushed glass, power plant ash, fly ash, coal ash, iron blast furnace slag, cement manufacturing slag, steel slag, and mixtures thereof.

The present disclosure will further be illustrated in the following non-limiting working examples, it being understood that these examples are intended to be illustrative only and that the disclosure is not intended to be limited to the materials, conditions, process parameters and the like recited herein.

EXAMPLES

Some geocells were made and tested for their stress-strain response, DMA properties and their impact on granular material bearing capacity.

Generally, the tensile stress-strain properties were measured by the Izhar procedure previously described.

The load at different deflections was measured or translated to Newtons (N). The deflection is measured or translated to millimeters (mm). The stress was calculated by dividing the load at a specific deflection by the original cross-section of the strip (original width multiplied by original thickness, wherein thickness is the nominal peak-to peak distance between upper face and bottom face). The strain (%) was calculated by dividing the specific deflection (mm) by the original length (mm) and multiplying by 100.

Comparative Example 1

A geocell made from high density polyethylene (HDPE) commercially available from Presto Geosystems (Wisconsin, USA) was obtained and its properties tested. The average cell wall thickness was 1.5 mm and the strip had a texture of diamond like vertical cells. The geocell was non-perforated. Its stress-strain response according to the Izhar procedure and is shown in Table 1.

TABLE 1

| | Stress (MPa) | | | | | | | |
|---|---|---|---|---|---|---|---|---|
| | 7.874 | 10.499 | 12.336 | 13.386 | 13.911 | 14 | 14 | 14 |
| Strain (%) | 2 | 4 | 6 | 8 | 10 | 12 | 14 | 16 |

At strain of about 8% and a stress of about 13.4 MPa, the Comparative Example began undergoing severe plastic deformation and actually reached its yield point at about 8% strain. In other words, after the release of stress, the sample did not recover its original length, but remained longer permanently (permanent residual strains). This phenomenon is undesirable for cellular confinement systems for load support applications—especially those subjected to many (10,000-1,000,000 and more cycles during the product life cycle) and is the reason for the poor performance of HDPE geocells as load supports for pavements and railways.

Example 1

An HDPE strip was extruded, and embossed to provide a texture similar to Comparative Example 1. The strip had a thickness of 1.7 mm, and was then stretched at a temperature of 100° C. (on the strip surface) so that the length was increased by 50% and the thickness was reduced by 25%. The stress-strain response of this HDPE strip was measured according to the Izhar procedure and is shown in Table 2.

TABLE 2

| | Stress (MPa) | | | | | | | | |
|---|---|---|---|---|---|---|---|---|---|
| | 8 | 10.8 | 12.5 | 13.7 | 14.5 | 15.2 | 15.8 | 16.5 | 17.3 |
| Strain (%) | 1.9 | 3.3 | 4.8 | 6 | 6.6 | 7.6 | 8.8 | 10.5 | 12 |

The strip of Example 1 maintained an elastic response up through 12% strain without a yield point and without reaching its plastic limit and at stresses greater than 17 MPa. The recovery of initial dimensions, after release of load, was close to 100%.

Example 2

A high performance polymeric alloy composition comprising 12 wt % polyamide 12, 10 wt % polybutylene terephthalate, 5% polyethylene grafted by maleic anhydride compatibilizer (Bondyram® 5001 manufactured by Polyram), and 73% HDPE was extruded to form a texturized sheet of 1.5 mm thickness. The stress-strain response of a strip formed from the composition was measured according to the Izhar procedure and is shown in Table 3.

TABLE 3

| | Stress (MPa) | | | | | | | | |
|---|---|---|---|---|---|---|---|---|---|
| | 8 | 10.8 | 12.5 | 13.7 | 14.5 | 15.2 | 15.8 | 16.5 | 17.3 |
| Strain (%) | 1.9 | 3.6 | 5.2 | 6.8 | 7.9 | 8.9 | 10 | 12 | 14 |

The strip of Example 2 maintained an elastic response up through 14% strain and at stresses greater than 17 MPa, without a yield point and without reaching its plastic limit. The recovery of initial dimensions, after release of load, was close to 100%.

Figure 5:
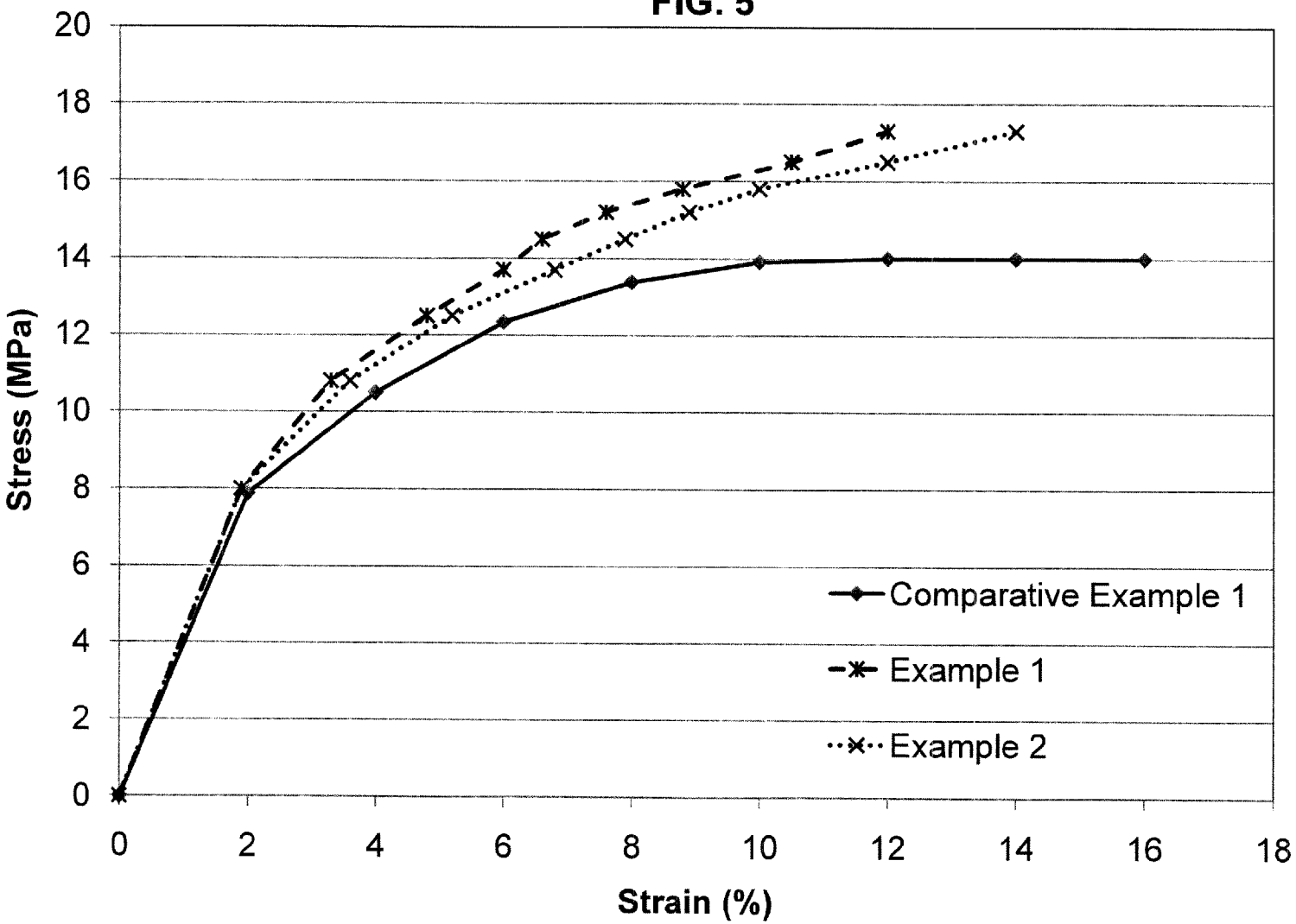
FIG. 5 is a graph comparing the stress-strain results of various cells of the present disclosure against a comparative example.

FIG. 5 is a graph showing the stress-strain results for Comparative Example 1, Example 1, and Example 2. An additional point at (0,0) has been added for each result. As can be seen, Example 1 and Example 2 have no sharp yield point, and maintained increase in stress without yield up to 12-14% strain at stresses of greater than 17 MPa, while the Comparative Example 1 reached its yield point at 8-10% strain and a stress of about 14 MPa. This translates into a greater range at which an elastic response is maintained. The fact that no yield point was observed for Example 1 and Example 2 is important when cyclic loading is expected and the ability to return to the original dimensions (and thus the maximal confinement of infill) is crucial.

Figure 6:
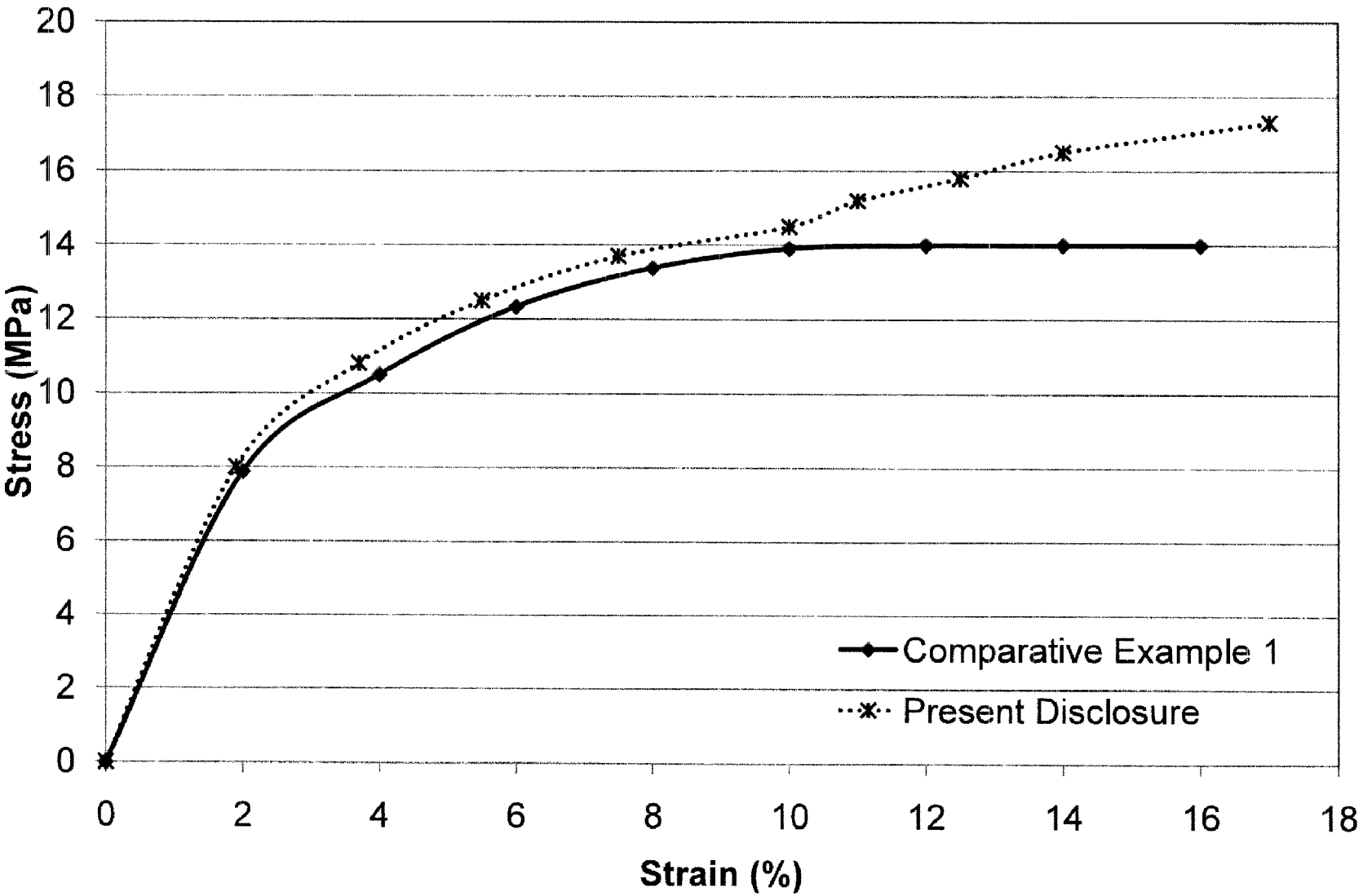
FIG. 6 is a graph showing the stress-strain diagram for the geocells of the present disclosure.

FIG. 6 is a graph showing the difference between the stress-strain result of Comparative Example 1 and a polymeric strip of the present disclosure which is characterized as having a strain of at most 1.9% at a stress of 8 MPa; a strain of at most 3.7% at a stress of 10.8 MPa; a strain of at most 5.5% at a stress of 12.5 MPa; a strain of at most 7.5% at a stress of 13.7 MPa; a strain of at most 10% at a stress of 14.5 MPa; a strain of at most 11% at a stress of 15.2 MPa; a strain of at most 12.5% at a stress of 15.8 MPa; a strain of at most 14% at a stress of 16.5 MPa; and a strain of at most 17% at a stress of 17.3 MPa. The area to the left of the dotted line defines the combinations of stress-strain according to the present disclosure.

Example 3

Two cells were tested to demonstrate the improvement in granular material reinforcement and increased load-bearing capacity. These cells were a single cell, not a complete geocell. As a control, one cell corresponding to Comparative Example 1 was used. For comparison, a cell was made from a composition according to Example 2, texturized, and had a thickness of 1.5 mm.

The walls of each cell were 10 cm high, 33 cm between seams, embossed, non perforated, and had a thickness of 1.5 mm. The cell was opened so that its long "radius" was about 260 mm and its short radius was about 185 mm. A sandbox of 800 mm length and 800 mm width was filled to 20 mm depth with sand. The sand gradation distribution is provided in Table 4.

TABLE 4

| | Sieve aperture (mm) | | | | | |
|---|---|---|---|---|---|---|
| | 0.25 | 0.5 | 0.75 | 1 | 2 | 4 |
| Cumulative Passing % | 10-20 | 35-55 | 50-70 | 60-80 | 80-90 | 90-100 |

The cell was placed on the surface of this sand and filled with the same sand. The expanded cell had a roughly elliptical shape, about 260 mm on the long axis and about 180 mm on the short axis. Additional sand was then placed into the sandbox to surround the cell and bury the cell so that a top layer of 25 mm covered the cell. The sand was then compacted to 70% relative density.

A piston of 150 mm diameter was placed above the center of the cell and the load was increased to provide pressure on the sand surface in 50 kPa increments (i.e. the pressure was increased every 1 minute by 50 KPa). The deflection (penetration of piston into the confined sand) and pressure (vertical load divided by piston area) were measured.

The piston was used on (1) sand only; (2) a cell of Comparative Example 1; and (3) a cell of Example 2. The results are shown in Table 5.

TABLE 5

| | Vertical Load (kPa) | | | | | | | | | |
|---|---|---|---|---|---|---|---|---|---|---|
| | 100 | 150 | 200 | 250 | 300 | 350 | 400 | 450 | 500 | 550 |
| Deflection in sand only (mm) | 1 | 2 | 3 | >10 | >15 | >20 | >20 | >20 | >20 | >20 |
| Deflection with cell of Comparative Example 1 (mm) | 0.7 | 1.3 | 2 | 2.5 | 3 | 4 | 5 | >10 | >15 | >20 |
| Deflection with cell of Example 2 (mm) | 0.6 | 1 | 1.1 | 1.7 | 2 | 2.5 | 2.9 | 4 | 5 | 7 |

The cell of Example 2 continued to perform elastically at pressures greater than 400 kPa, whereas the cell of Comparative Example 1 did not. Due to the yielding of the HDPE wall, poor confinement was observed in the cell of Comparative Example 1. The yield point for Comparative Example 1 was at vertical pressure of about 250 KPa, and if the average hoop stress is calculated (average diameter of cell is 225 mm) at that vertical pressure, a value of about 13.5 MPa is obtained. This number is in very good agreement with the yield point values obtained by the stress-strain tensile measurements according to the Izhar procedure. The results showed there was a strong and significant correlation between the stiffness and resistance to yield (ability to carry hoop stresses greater than 14 MPa) and the ability to support a large vertical load. It should be noted that this test only provided a single load, whereas in practical applications the load to be supported is cyclic. As a result, the resistance to plastic deformation is very important and was not present in the cell of Comparative Example 1.

Figure 7:
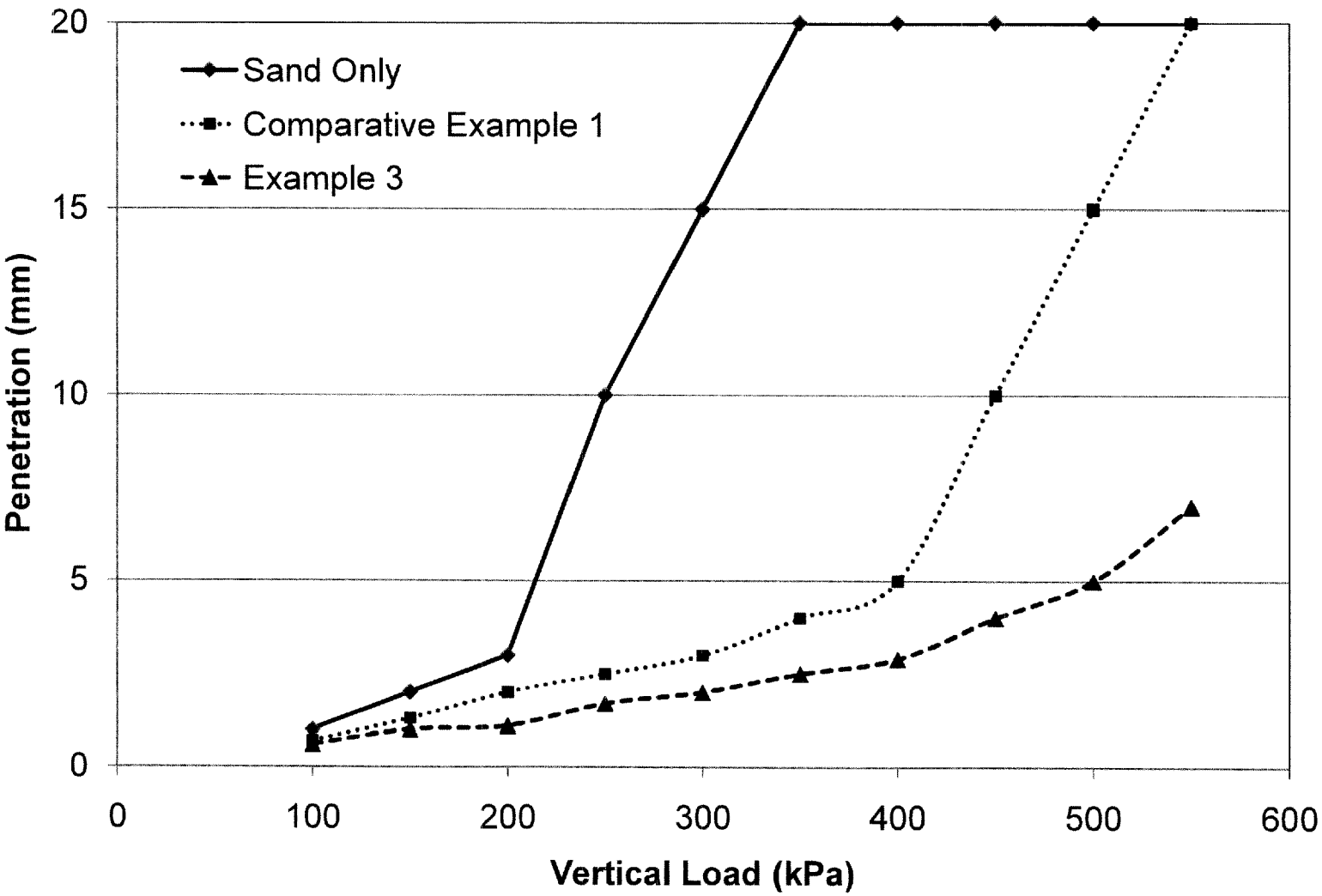
FIG. 7 is a graph showing the results of a vertical load test for an exemplary cell of the present disclosure against a comparative example.

FIG. 7 is a graph showing the results in Table 5. The difference in resistance to penetration (i.e. how well the cell supported the vertical load) is very clear.

Example 4

A polymeric strip was made according to Example 2.

As a control, an HDPE strip of 1.5 mm thickness according to Comparative Example 1 was provided.

The two strips were then analyzed by Dynamic Mechanical Analysis (DMA) at a frequency of 1 Hz according to ASTM D4065. The control HDPE strip was tested over a temperature range of about −150° C. to about 91° C. The control strip was heated at 5° C./min and the force, displacement, storage modulus, and tan delta were measured. The polymeric strip of Example 2 was tested over a temperature range of about −65° C. to about 120° C. The control strip was heated at 5° C./min and the force, displacement, storage modulus, and tan delta were measured.

Figure 8:
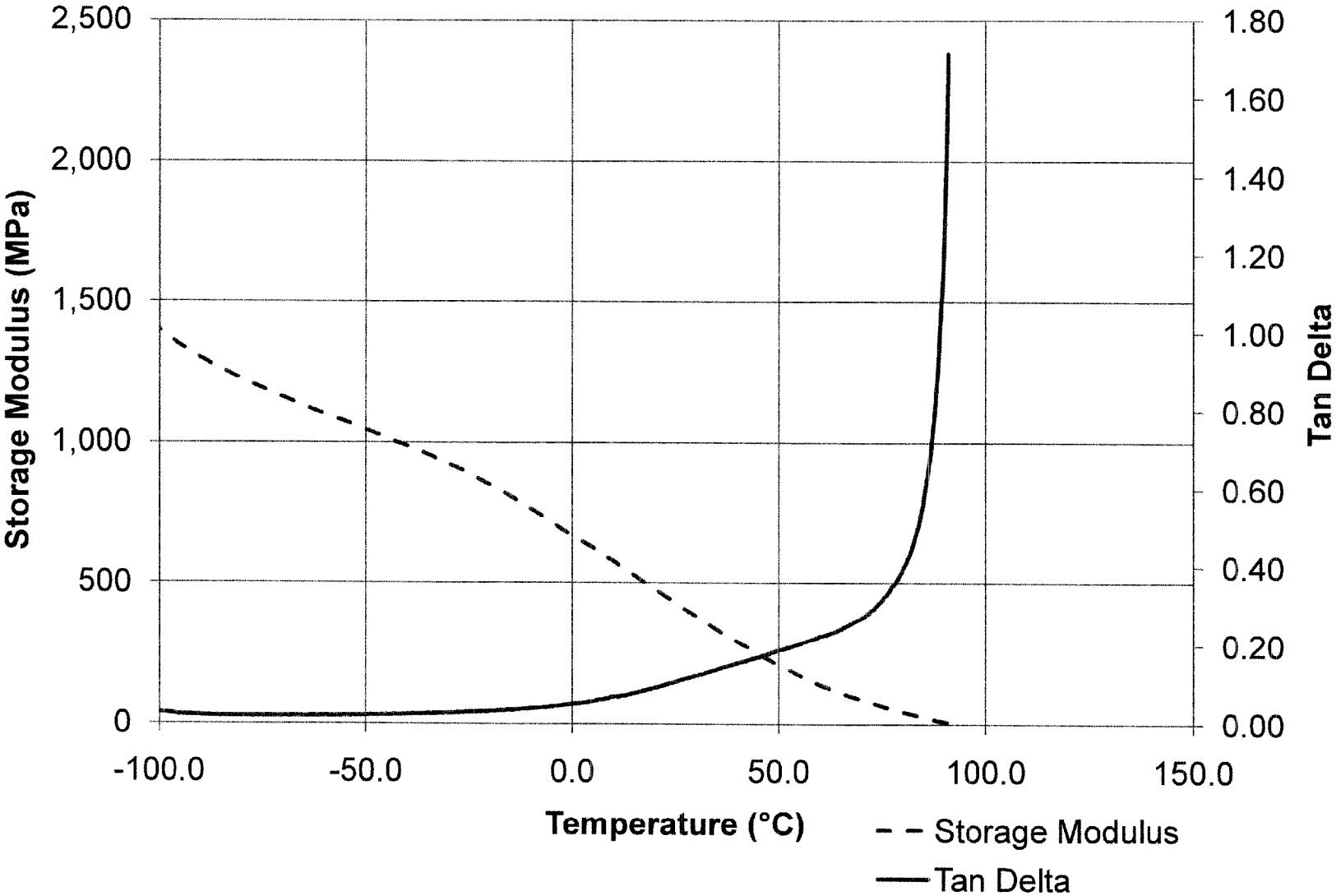
FIG. 8 is a graph of the storage modulus and Tan Delta versus temperature for a control strip.

FIG. 8 is a graph of the storage (elastic) modulus and Tan Delta versus temperature for the control HDPE strip.

Figure 9:
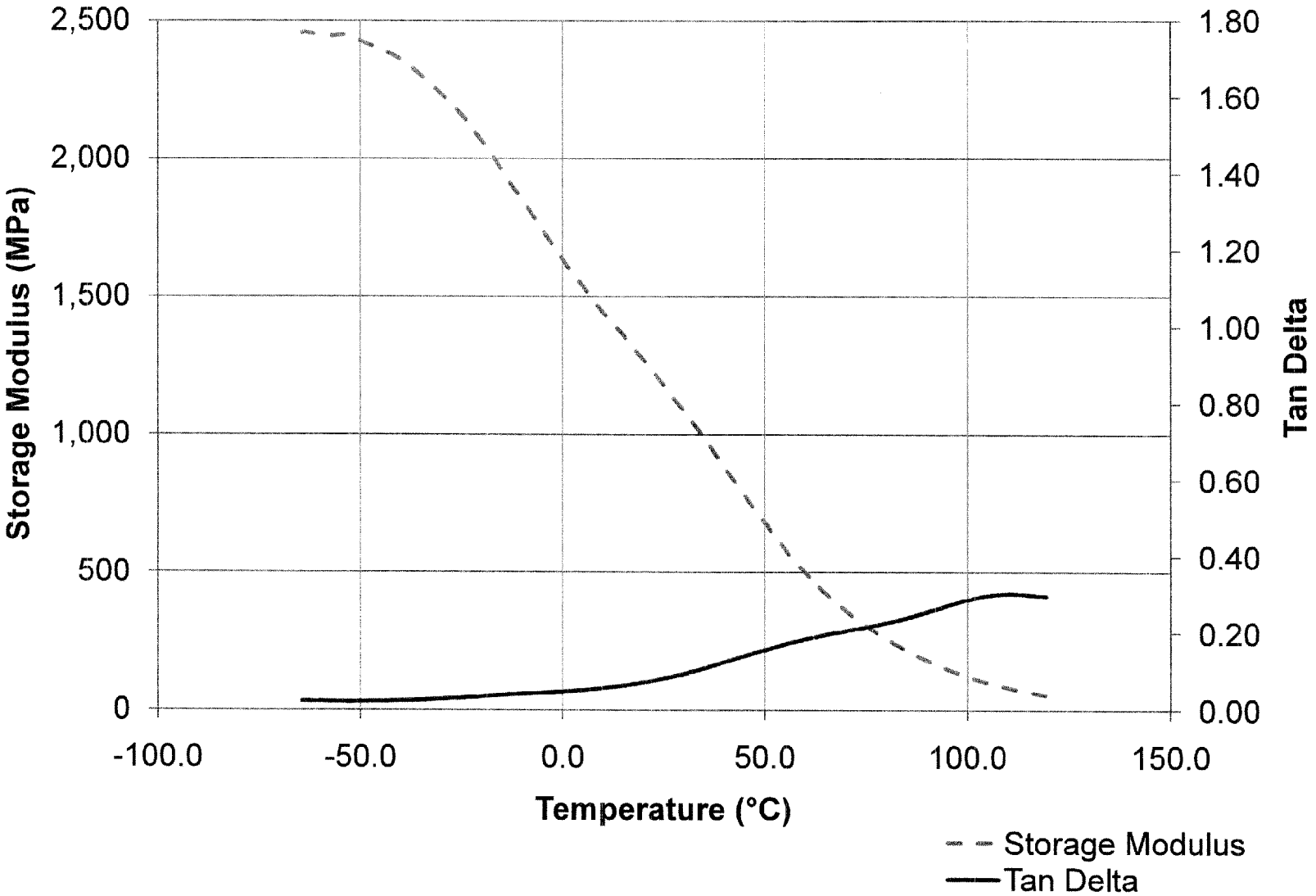
FIG. 9 is a graph of the storage modulus and Tan Delta versus temperature for a polymeric strip used in the geocells of the present disclosure.

FIG. 9 is a graph of the storage (elastic) modulus and Tan Delta versus temperature for the polymeric strip of Example 2.

The storage modulus of the HDPE decreased more rapidly than the storage modulus of Example 2. The storage modulus for the strip of Example 2 was almost three times higher than the storage modulus for the HDPE strip at 23° C. To obtain the same storage modulus as the HDPE strip had at 23° C., the strip of Example 2 had to be heated to almost 60° C., i.e. the strip of Example 2 maintained its storage modulus better.

The Tan Delta for the HDPE strip increased exponentially starting at around 75° C., indicating a loss of elasticity (i.e. the material became too plastic and would not retain sufficient stiffness and elasticity), so that the strip was viscous and plastic. This is undesirable, as geocells can be heated even when placed underground (such as in a road). The Tan Delta for the strip of Example 2 maintained its properties at temperatures as high as 100° C. This property is desirable as it provides an additional safety factor. Since performance at elevated temperatures is a way to predict long term performance at moderate temperatures (as described in ASTM 6992), the fact that HDPE began losing its elasticity and thus its load support potential at about 75° C. within seconds, provides some insight about its poor creep resistance and tendency to plastically deform. Unlike HDPE, the composition according to the present disclosure, kept its elasticity (low Tan Delta) at very high temperatures, thus suggesting that it has the potential to retain its properties for many years and many loading cycles.

Example 5

Three strips were tested according to the PRS SIM procedure to determine their long term design stress (LTDS). As a control, one HDPE strip was made according to comparative example 1. The first test strip was one made according to Example 2. The second test strip was one made according to Example 2, then oriented at 115° C. to increase its original length by 40%). The results are shown in Table 6 below.

TABLE 6

| Geocell | Comparative Example 1 | Example 2 | Oriented Example 2 |
|---|---|---|---|
| LTDS (MPa) | 2.2 | 3 | 3.6 |

As seen here, Example 2 and Oriented Example 2 both had higher LTDS compared to Comparative Example 1.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A geocell formed from a plurality of polymeric strips, at least one polymeric strip having a storage modulus of 500 MPa or greater when measured in the machine direction by Dynamic Mechanical Analysis (DMA) according to ASTM D4065 at 23° C. and at a frequency of 1 Hz.

2. The geocell of claim 1, wherein the at least one polymeric strip has a storage modulus of 700 MPa or greater.

3. The geocell of claim 1, wherein the at least one polymeric strip has a storage modulus of 1000 MPa or greater.

4. The geocell of claim 1, wherein the at least one polymeric strip has a stress at 12% strain of 14.5 MPa or greater when measured according to the Izhar procedure at 23° C.

5. The geocell of claim 1, wherein the at least one polymeric strip has a stress at 12% strain of 16 MPa or greater when measured according to the Izhar procedure at 23° C.

6. The geocell of claim 1, wherein the at least one polymeric strip has a stress at 12% strain of 18 MPa or greater when measured according to the Izhar procedure at 23 C.

7. The geocell of claim 1, wherein the at least one polymeric strip has a coefficient of thermal expansion of $120\times 10^{-6}$/° C. or less at 25° C. according to ASTM D696.

8. A pavement, road, railway, or parking area, comprising at least one layer comprising the geocell of claim 1.

9. The pavement, road, railway, or parking area of claim 8, wherein the geocell is filled with a granular material selected from the group consisting of sand, gravel, crushed stone, ballast, quarry waste, crushed concrete, recycled asphalt, crushed bricks, building debris and rubble, crushed glass, power plant ash, fly ash, coal ash, iron blast furnace slag, cement manufacturing slag, steel slag, and mixtures thereof.

10. A geocell formed from a plurality of polymeric strips, at least one polymeric strip having a storage modulus of 150 MPa or greater when measured in the machine direction by Dynamic Mechanical Analysis (DMA) according to ASTM D4065 at 63° C. and at a frequency of 1 Hz.

11. The geocell of claim 10, wherein the at least one polymeric strip has a storage modulus of 250 MPa or greater.

12. The geocell of claim 10, wherein the at least one polymeric strip has a storage modulus of 400 MPa or greater.

13. The geocell of claim 10, wherein the at least one polymeric strip has a stress at 12% strain of 14.5 MPa or greater when measured according to the Izhar procedure at 23° C.

14. The geocell of claim 10, wherein the at least one polymeric strip has a stress at 12% strain of 16 MPa or greater when measured according to the Izhar procedure at 23° C.

15. The geocell of claim 10, wherein the at least one polymeric strip has a stress at 12% strain of 18 MPa or greater when measured according to the Izhar procedure at 23° C.

16. The geocell of claim 10, wherein the at least one polymeric strip has a coefficient of thermal expansion of $120\times 10^{-6}$/° C. or less at 25° C. according to ASTM D696.

17. A pavement, road, railway, or parking area, comprising at least one layer comprising the geocell of claim 10.

18. The pavement, road, railway, or parking area of claim 17, wherein the geocell is filled with a granular material selected from the group consisting of sand, gravel, crushed stone, ballast, quarry waste, crushed concrete, recycled asphalt, crushed bricks, building debris and rubble, crushed glass, power plant ash, fly ash, coal ash, iron blast furnace slag, cement manufacturing slag, steel slag, and mixtures thereof.

19. A geocell formed from a plurality of polymeric strips, adjacent strips being bonded together to form a honeycomb pattern when stretched in a direction perpendicular to the faces of the strips, at least one polymeric strip having a long term design stress of 2.6 MPa or greater, when measured according to the PRS SIM procedure.

20. The geocell of claim 19, wherein the at least one polymeric strip has a long term design stress of 3 MPa or greater, when measured according to the PRS SIM procedure.

21. The geocell of claim 19, wherein the at least one polymeric strip has a long term design stress of 4 MPa or greater, when measured according to the PRS SIM procedure.

22. The geocell of claim 19, wherein the at least one polymeric strip has a stress at 12% strain of 14.5 MPa or greater when measured according to the Izhar procedure at 23° C.

23. The geocell of claim 19, wherein the at least one polymeric strip has a stress at 12% strain of 16 MPa or greater when measured according to the Izhar procedure at 23° C.

24. The geocell of claim 19, wherein the at least one polymeric strip has a stress at 12% strain of 18 MPa or greater when measured according to the Izhar procedure at 23° C.

25. The geocell of claim 19, wherein the at least one polymeric strip has a coefficient of thermal expansion of $120\times10^{-6}$/° C. or less at 25° C. according to ASTM D696.

26. A pavement, road, railway, or parking area, comprising at least one layer comprising the geocell of claim 19.

27. The pavement, road, railway, or parking area of claim 26, wherein the geocell is filled with a granular material selected from the group consisting of sand, gravel, crushed stone, ballast, quarry waste, crushed concrete, recycled asphalt, crushed bricks, building debris and rubble, crushed glass, power plant ash, fly ash, coal ash, iron blast furnace slag, cement manufacturing slag, steel slag, and mixtures thereof.

* * * * *